US007927117B2

(12) United States Patent
Yu et al.

(10) Patent No.: US 7,927,117 B2
(45) Date of Patent: Apr. 19, 2011

(54) ELECTRICAL CARD CONNECTOR

(75) Inventors: Jian-Fei Yu, Kunshan (CN); Qi-Jun Zhao, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/660,769

(22) Filed: Mar. 3, 2010

(65) Prior Publication Data

US 2010/0227489 A1 Sep. 9, 2010

(30) Foreign Application Priority Data

Mar. 3, 2009 (CN) ..... 2009 2 0301022

(51) Int. Cl.
*H01R 13/62* (2006.01)

(52) U.S. Cl. ..... 439/159; 439/630

(58) Field of Classification Search ..... 439/152, 439/157, 159, 160, 630
See application file for complete search history.

(56) References Cited

U.S. PATENT DOCUMENTS

| | | | | |
|---|---|---|---|---|
| 6,776,632 | B2 | 8/2004 | Kikuchi et al. | |
| 7,033,190 | B1 * | 4/2006 | Chen | 439/159 |
| 7,326,071 | B1 * | 2/2008 | Ho et al. | 439/159 |
| 7,361,035 | B1 * | 4/2008 | Lai | 439/155 |
| 7,484,976 | B2 * | 2/2009 | Ezaki | 439/159 |
| 7,651,352 | B1 * | 1/2010 | Chen et al. | 439/159 |
| 2009/0246993 | A1 | 10/2009 | Yu et al. | |

* cited by examiner

*Primary Examiner* — Thanh-Tam T Le
(74) *Attorney, Agent, or Firm* — Wei Te Chung; Andrew C. Cheng; Ming Chieh Chang

(57) ABSTRACT

An electrical card connector defines a receiving space for receiving an electrical card, and includes an insulative housing and an ejecting mechanism retained in the insulative housing. The ejecting mechanism includes a slider, a coil spring for driving the slider moving along an insertion direction of the electrical card, and a latch spring secured on the slider and extending into the receiving space for pressing on the electrical card. The electrical card connector further includes a limiting portion abutting against the latch spring to increase a lock force on the electrical card, thus the electrical card would be prevented from flying out of the electrical card connector.

8 Claims, 5 Drawing Sheets

ELECTRICAL CARD CONNECTOR

BACKGROUND OF THE INVENTION

1. Field of the Invention

The present invention relates to an electrical card connector for preventing an electrical card from flying out from a given ejection position.

2. Description of Related Art

Usually, electrical device such as digital camera and PDA deploys an electrical card for increasing the storage of the device. An electrical card connector is used for connecting the electrical card to the electrical device. Electrical card connector in early stage just comprises an insulative housing, a plurality of terminals retained in the insulative housing for contacting with an electrical card, and a metal shell covering the insulative housing. A part of the electrical card exposes to the outside of the electrical card connector for ejecting itself conveniently. Indeed, some electrical card connectors further include a push-push type ejecting mechanism for pushing the electrical card into or out of the electrical card connectors. The ejecting mechanism includes a slider moveable in the insulative housing, a coiled spring abutting against the slider, a link rod for controlling positions of the slider, and a locking spring for holding the electrical card in the electrical connector and avoiding the electrical card from drawing out of the connector by mistake. The electrical card has a cutout at one side thereof for receiving the locking spring so as to lock the electrical card into the electrical card connector.

While the electrical card is ejected out of the electrical card connector by the ejecting mechanism, the coil spring urges the slider to drive the electrical card move toward an insertion opening of the electrical card connector. The slider will be stoped by the insulative housing. But the electrical card will continue to move as original speed by an inertia force, thus the electrical card would fly out of the electrical card connector via break away from the locking spring.

Hence, an improved electrical card connector is desired to overcome the above problems.

BRIEF SUMMARY OF THE INVENTION

According to one aspect of the present invention, an electrical card connector, comprises an insulative housing defining a front mating face and a receiving space extending backwardly from the mating face for receiving an electrical card; a plurality of contacts retained in the insulative housing for mating with the electrical card; an ejecting mechanism disposed in the insulative housing, the ejecting mechanism including a movable slider, a coil spring urging the slider forwardly, a link rod for controlling the slider to be positioned at a first position or a second position farther away from the mating face than the first position, and a latch spring fixed on the slider, the latch spring defining a resistive portion protruding into the receiving space for locking the electrical card; and an elastic limiting portion disposed on the insulative housing and positioned at the first position, the limiting portion extending into the receiving space to abut against the latch spring while being deflected by the electrical card.

According to another aspect of the present invention, an electrical card connector, comprises an insulative housing defining a front mating face and a receiving space extending backwardly from the mating face for receiving an electrical card; a plurality of contacts received in the insulative housing for engaging with the electrical card; an ejecting mechanism disposed in the insulative housing and including a slider, a coil spring urging the slider to slide in the insulative housing along an card insertion direction, a link rod for controling positions of the slider respect to the insulative housing, and a latch spring retained on the slider, the latch spring having a retaining portion retained on the slider, a hook protruding into the receiving space for buckling in a side cutout of the electrical card, and a spring portion extending from the retaining portion to the hook along the card insertion direction; and a metal shell covering the insulative housing and defining a limiting portion protruding into the receiving space and above the latch spring; wherein the slider would positioned at a first position while the hook of the latch just locks into the cutout of the electrical card, and a second position while the contact electrical connecting with the electrical card; wherein the spring portion defines a front end toward the hook, and a rear end toward the retaining portion; wherein the limiting portion abuts against the front end of the spring portion at the first position and the rear end of the spring portion at the second position respectively while the latch spring being deflected by the electrical card.

Other objects, advantages and novel features of the present invention will become more apparent from the following detailed description of the present embodiment when taken in conjunction with the accompanying drawings.

DETAILED DESCRIPTION OF THE PREFERRED EMBODIMENTS

Figure 1:
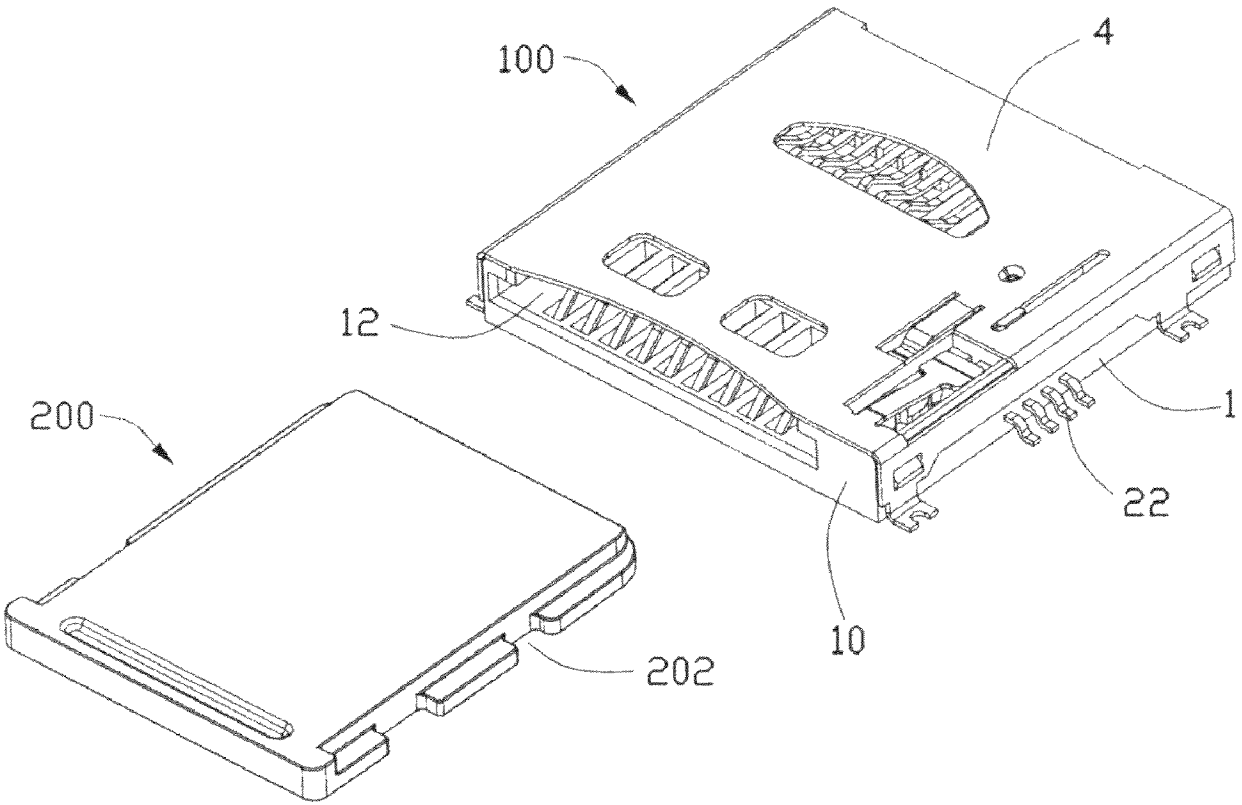
FIG. 1 is a perspective view of an electrical card connector with an electrical card for being inserted therein according to the present invention.
Figure 2:
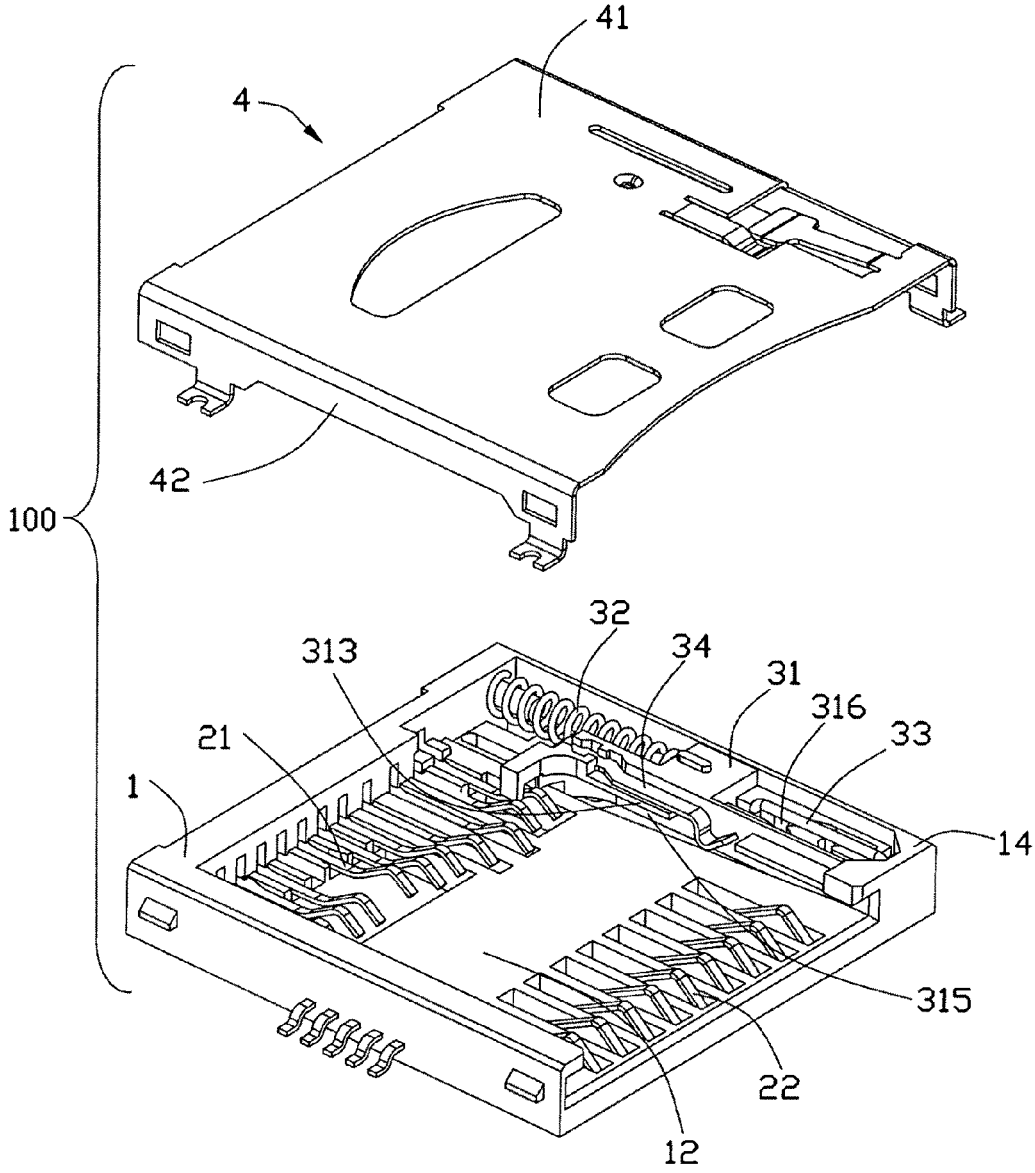
FIG. 2 is a part exploded view of the electrical card connector shown in FIG. 1.
Figure 3:
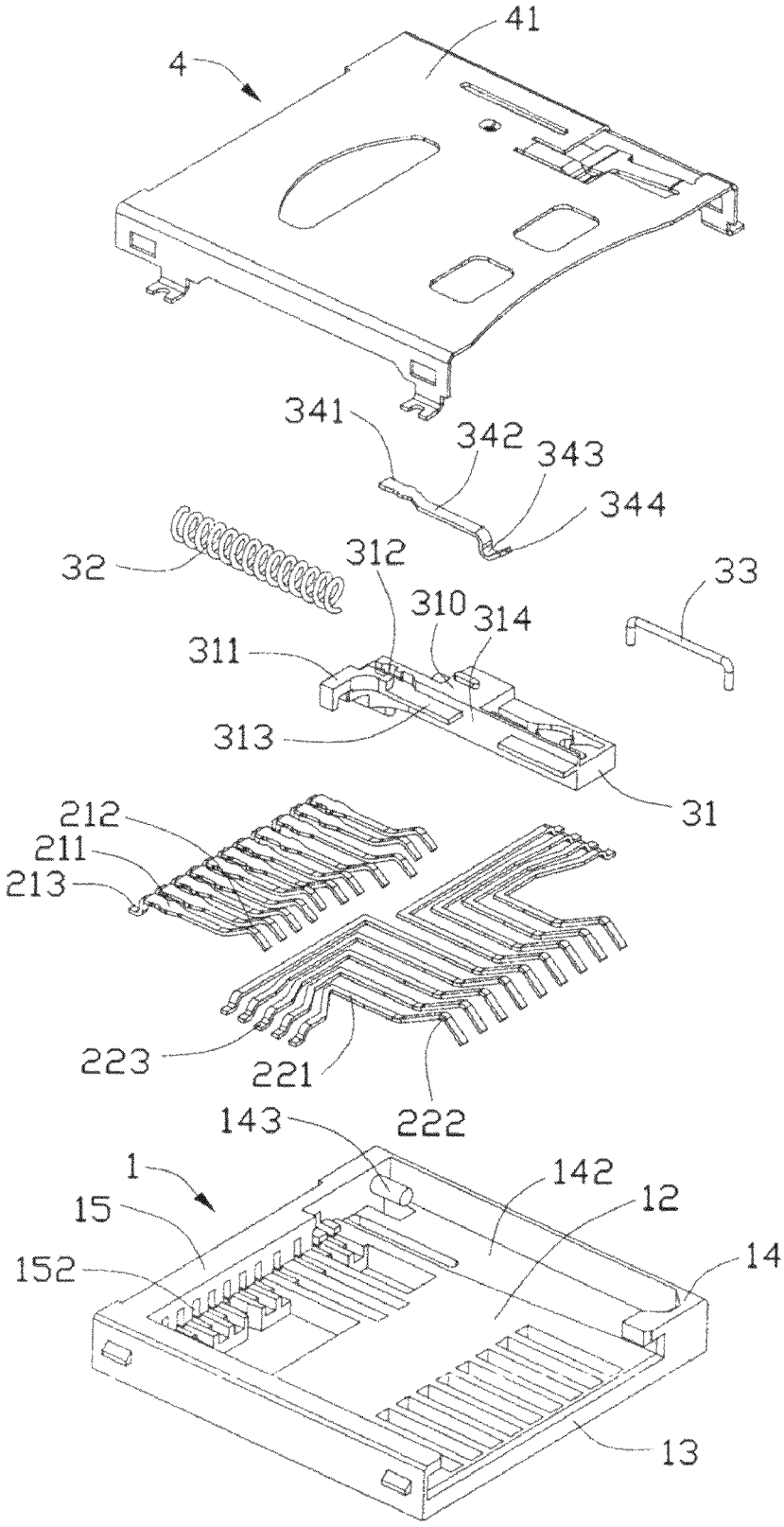
FIG. 3 is an exploded view of the electrical card connector shown in FIG. 1.
Figure 4:
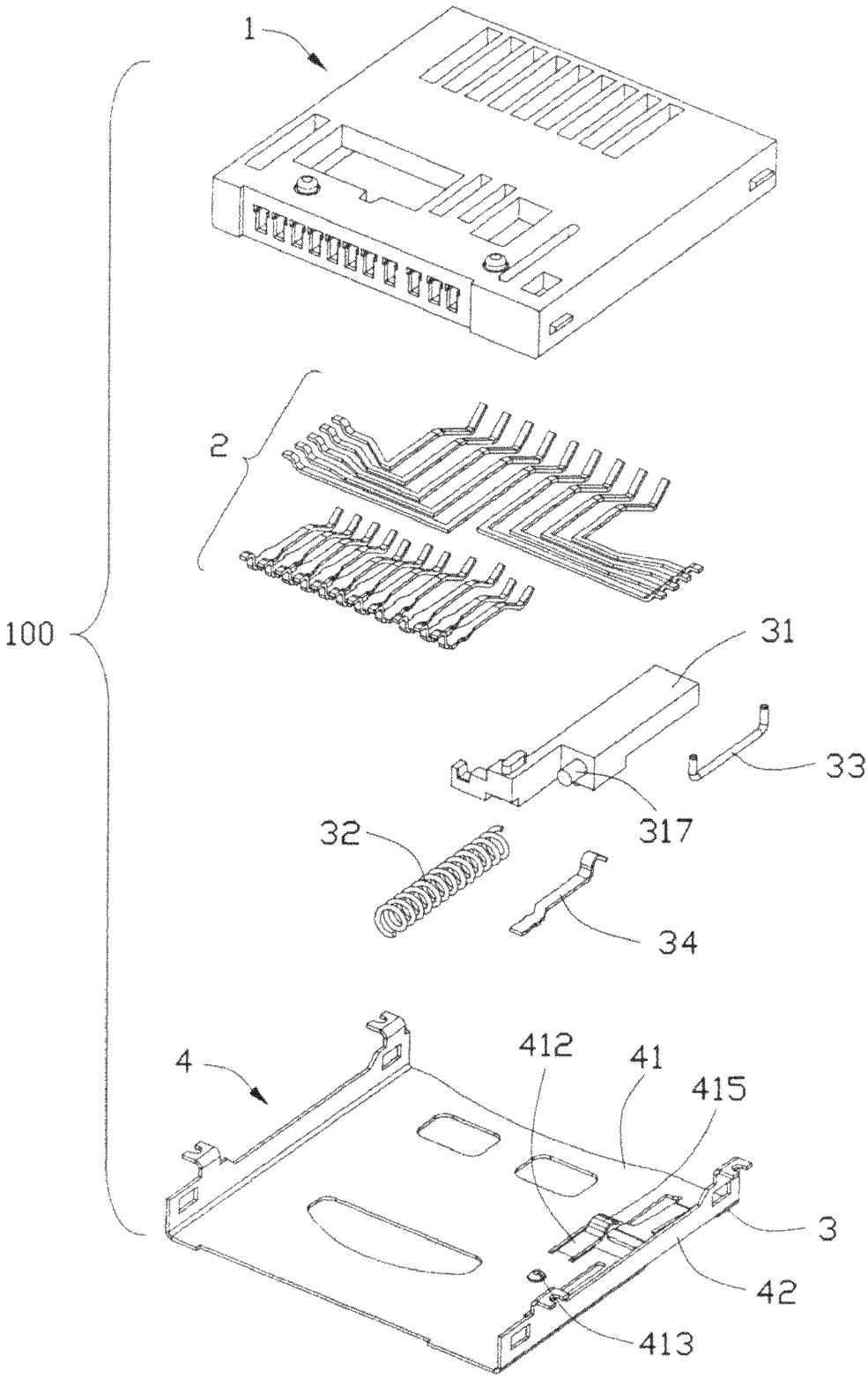
FIG. 4 is another explode view of the electrical card connector shown in FIG. 1.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-5, an electrical card connector 100 for receiving an electrical card 200, comprises an insulative housing 1, a plurality of contacts 2 retained in the insulative housing 1, a push-push type ejecting mechanism 3 fixed in the insulative housing 1, and a metal shell 4 covering the insulative housing 1. The electrical card 200 has a cutout 202 at one side thereof. The electrical card connector 100 defines a front mating face 10 and a receiving space 12 extending backwardly from the mating face 10 for receiving the electrical card 200.

The insulative housing 1 has a bottom wall 13, two opposite side walls 14 extending upwardly from two lateral sides of the bottom wall 13, and a rear wall 15 extending upwardly from a rear end of the bottom wall 13. The rear wall 15 defines a plurality of passages 152 to retain the contacts 2. One of the side walls 14 of the insulative housing 1 has a receiving cavity 142 for receiving the ejecting mechanism 3 and a first post 143 extending forwardly from a rear end of the side wall 14 into the receiving cavity 142.

The contacts 2 are divided into a first contact group 21 and a second contact group 22 arranged along an card insertion direction. Each contact 2 includes a securing portion 211, 221, a contact portion 212, 222 protruding from the securing portion 211, 221 into the receiving space 12 for connecting with the electrical card 200, and a soldering portion 213, 223 extending from the securing portion 211, 221 out of the insulative housing 1. The securing portions 211 of the first contact group 21 are retained into the passages 152 of the insulative housing 1. The securing portions 221 of the second contact group 22 are insert molded into the bottom wall 13 of the insulative housing 1.

The push-push type ejecting mechanism 3 comprises a slider 31 moveably received in the receiving cavity 142 of the insulative housing 1, a coiled spring 32 having a rear end retained in the first post 143 and a front end for abutting against the slider 31, a link rod 33 for controlling positions of the slider 31, and a first spring 34 secured in the slider 31. The link rod 33 is used for controlling the slider 31 to be positioned at a first position or a second position farther away from the mating face 10 than the first position. The first position is a start position of the slider 32 before the electrical card 200 inserted in the electrical card connector 100. The second position is a last position of the slider 32 with the contacts 2 electrical connecting with the electrical card 200.

The slider 31 includes a main portion 310 and a protrusion 311 extending from a rear end of the main portion 310 into the receiving space 12 for abutting against a front end of the electrical card 200. The main portion 310 has a positioning slot 312 recessed downwardly from a top surface thereof and a tablet 313 protruding into the receiving space 12 and extending along the main portion 310. The tablet 313 is above the bottom wall 15 to form a receiving slot 315 to receiving a side with the cutout 202 of the electrical card 200. A middle portion of the tablet 313 defines a recess 314 extending therethrough along an vertical direction of the insulative housing 1. The slider 31 includes a heart-shaped track 316 recessed from the top surface of the main portion 310 to guide the link rod 33. The second post 317 extends backwardly from the rear end of the slider 31. The front end of the coil spring 32 is retained on the second post 317 of the slider 31.

The first spring 34 includes a retaining portion 341 retained in the position slot 312 of the slider 31, a spring portion 342 extending forwardly from the retention 341 toward the mating face 10, an U-shaped hook 343 extending forwardly and bending downwardly from the spring portion 342, and a distal engaging portion 344 extending from the hook 343. The hook 343 protrudes downwardly through the recess 314 of the slider 31 into the receiving space 12 for locking within the cutout 202 of the electrical card 200. The spring portion 342 extends along the tablet 313 and is supported upwardly by the tablet 313.

The metal shell 4 is made of a piece of metal sheet, and comprises a top wall 41 and a pair of side walls 42 bending downwardly from two lateral sides of the top wall 41. The top wall 41 has a second spring 412 disposed at the first position and an emboss 413 disposed at the second position. Both of the second spring 412 and emboss 413 protrude downwardly into the receiving space 12. The second spring 412 extends forwardly and defines an arc limiting portion 415 bending downwardly for engaging with the engaging portion 344 of the first spring 34 and disposed opposite to the emboss 413.

The slider 31 is located at the first position before the electrical card 200 inserted into the receiving space 12. When the electrical card 200 being inserted into the receiving space 12 normally, one side of the electrical card 200 resists the hook 343 upwardly firstly to urge the engaging portion 344 to abut against the limiting portion 415, the hook 343 locking into the cutout 200 of the electrical card 200. The front end of the electrical card 200 pushes the slider 31 moving backwardly along the card insertion direction. When the electrical card 200 is pushed backwardly to the second position. The contacts 2 electrical connect with the electrical card 200. The emboss 413 is above the spring portion 342 for preventing the spring portion 342 from upwardly over deflection.

Figure 5:
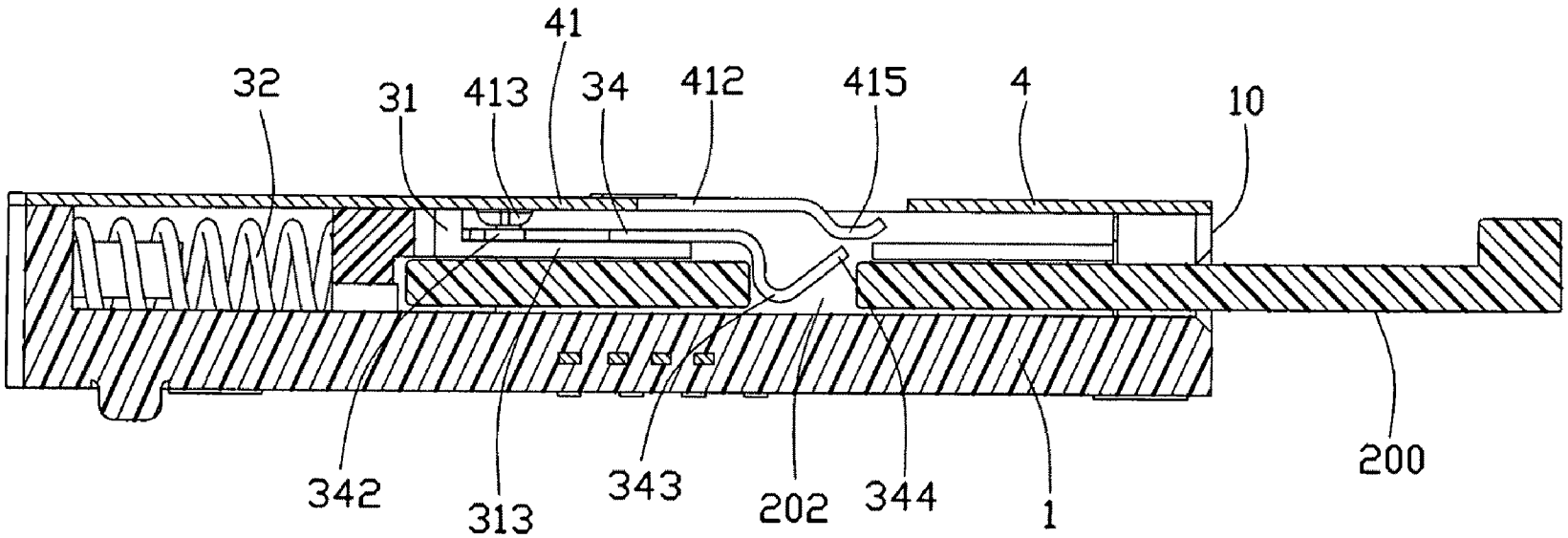
FIG. 5 is a cross-sectional view of the electrical card being inserted into the electrical connector shown in FIG. 1.

Referring to FIG. 5, during withdrawing the electrical card 200, an operator would push the electrical card 200 backwardly, the electrical card 200 is ejected by ejecting mechanism 3. The slider 31 drives the electrical card 200 move fastly from the second position to the first position togetherly. The slider 31 would be stoped by a front end of the side wall 14 When the slider 31 moves to the first position. But the electrical card 200 would continue to move as original speed by an inertia force. However, while the hook 343 drives the engaging portion 344 moving upwardly. The limiting portion 415 abuts against the engaging portion 344 downwardly to ensure the hook 343 lock into the cutout of the electrical card 200 reliably, and prevent the hook 343 from breaking away from the cutout 202 of the electrical card 200, thus the electrical card 200 can not fly out from the electrical card connector 100. Finally they electrical card 200 would be pulled out of the electrical card connector 100 by a hand of the operator.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

What is claimed is:

1. An electrical card connector, comprising:

an insulative housing defining a front mating face and a receiving space extending backwardly from the mating face for receiving an electrical card;

a plurality of contacts retained in the insulative housing for mating with the electrical card;

an ejecting mechanism disposed in the insulative housing, the ejecting mechanism including a movable slider, a coil spring urging the slider forwardly, a link rod for controlling the slider to be positioned at a first position or a second position farther away from the mating face than the first position, and a latch spring fixed on the slider, the latch spring defining a resistive portion protruding into the receiving space for locking the electrical card;

an elastic limiting portion disposed on the insulative housing and positioned at the first position, the limiting portion extending into the receiving space to abut against the latch spring while being deflected by the electrical card; and a metal shell covering the insulative housing and retained on the insulative housing, the limiting portion is integrated with the metal shell or insert molded into the insulative housing;

wherein the latch spring defines a hook protruding into a side cutout of the electrical card to lock with the electrical card;

wherein the latch spring defines a retaining portion retained on the slider, a spring portion located between the retaining portion and the hook, and a distal engaging portion extending from the hook to abut against the limiting portion, the hook protrudes downwardly from the spring portion, the limiting portion is located above the engaging portion; and wherein the metal shell includes a top wall and a pair of opposited side walls bending downwardly from two sides of the top wall, the top wall defines a spring arm, the limiting portion is an arc structure and disposed on a front end of the spring arm.

2. The electrical card connector as claimed in claim 1, wherein the top wall defines an emboss positioned at the second position to abut downwardly against the spring portion of the latch spring when the electrical card is inserted into the receiving space, the emboss is aligned with the limiting portion along an insertion direction of the electrical, card.

3. The electrical card connector as claimed in claim 1, wherein the slider defines a tablet extending sidely into the receiving space, the tablet is disposed between the spring portion and a side of the electrical card to prevent the spring portion from bending downwardly and preventing the electrical card from moving upwardly, the tablet defines a recess extending therethrough along an vertical direction of the insulative housing, the hook protruding downwardly through the recess into the receiving space.

4. The electrical card connector as claimed in claim 3, wherein the tablet is located above a bottom wall of the insulative housing to form a receiving slot to receiving a side edge of the electrical card, the cutout is formed on the side edge.

5. An electrical card connector, comprising:

an insulative housing defining a front mating face and a receiving space extending backwardly from the mating face for receiving an electrical card;

a plurality of contacts received in the insulative housing for engaging with the electrical card;

an ejecting mechanism disposed in the insulative housing and including a slider, a coil spring urging the slider to slide in the insulative housing along a card insertion direction, a link rod for controling positions of the slider respect to the insulative housing, and a latch spring retained on the slider, the latch spring having a retaining portion retained on the slider, a hook protruding into the receiving space for buckling in a side cutout of the electrical card, and a spring portion extending from the retaining portion to the hook along the card insertion direction; and a metal shell covering the insulative housing and defining a limiting portion protruding into the receiving space and above the latch spring;

wherein the slider would positioned at a first position while the hook of the latch just locks into the cutout of the electrical card, and a second position while the contact electrical connecting with the electrical card;

wherein the spring portion defines a front end toward the hook, and a rear end toward the retaining portion;

wherein the limiting portion abuts against the front end of the spring portion at the first position and the rear end of the spring portion at the second position respectively while the latch spring being deflected by the electrical card;

wherein the metal shell includes a top wall and a pair of opposited side walls bending downwardly from two sides of the top wall, the limiting portion protrudes downwardly from the top wall; and wherein the top wall defines a spring arm at front of the limiting portion and aligned with the limiting portion to abut against the latch spring at the first position while the latch spring being deflected by the electrical card.

6. The electrical card connector as claimed in claim 5, wherein the slider defines a heart-shaped track recessed from a top surface thereof to guide the link rod to move, both of the limiting portion and the spring arm are disposed at an inner side of the heart-shaped track.

7. The electrical card connector as claimed in claim 5, wherein the slider includes a protrusion extending into the receiving space from a rear end thereof for abuting against the electrical card, a tablet protruding into the receiving space and extending along the slider for abuting downwardly against a side of the electrical card and supporting the spring portion upwardly, a recess passes downwardly through the tablet, the hook protrudes downwardly into the receiving space.

8. An electrical card connector comprising:

an insulative housing defining a card receiving space;

a plurality of contacts disposed in the housing with contacting sections extending into the card receiving space;

an ejecting mechanism positioned on one side of the housing in a transverse direction, and including a slider moveable relative to the housing between opposite outer waiting and inner mating positions in a front-to-back direction perpendicular to said transverse direction;

a card locking spring secured to and commonly moveable with the slider in said front-to-back direction under condition that said card locking spring is deflectable in a vertical direction perpendicular to both said transverse direction and said front-to-back direction; and a spring limiting portion located above the card receiving space in the vertical direction, and limiting unexpected outward deflection of the card locking spring in said vertical direction when said slider in moved to the outer waiting position while allowing intentional outward deflection of the card locking spring in said vertical direction;

wherein the limiting portion is located on the metallic shell located upon the housing in said vertical direction; and wherein said shell further includes a stopper to prevent outward deflection of the card locking spring when said slider is moved to the inner mating position.

* * * * *